US008109509B2

(12) United States Patent
Nireki

(10) Patent No.: US 8,109,509 B2
(45) Date of Patent: Feb. 7, 2012

(54) PAPER SHEET PROCESSING DEVICE

(75) Inventor: Takao Nireki, Tokyo (JP)

(73) Assignee: Universal Entertainment Corporation, Tokyo (JP)

( * ) Notice: Subject to any disclaimer, the term of this patent is extended or adjusted under 35 U.S.C. 154(b) by 0 days.

(21) Appl. No.: 12/746,019

(22) PCT Filed: Dec. 2, 2008

(86) PCT No.: PCT/JP2008/071855

§ 371 (c)(1),
(2), (4) Date: Jun. 3, 2010

(87) PCT Pub. No.: WO2009/072485

PCT Pub. Date: Jun. 11, 2009

(65) Prior Publication Data

US 2010/0276866 A1 Nov. 4, 2010

(30) Foreign Application Priority Data

Dec. 3, 2007 (JP) ..... 2007-312201

(51) Int. Cl.
*B65H 5/00* (2006.01)

(52) U.S. Cl. ..... 271/264; 194/206

(58) Field of Classification Search ..... 271/264; 194/206

See application file for complete search history.

(56) References Cited

FOREIGN PATENT DOCUMENTS

| | | |
|---|---|---|
| JP | 1 78638 | 5/1989 |
| JP | 02 310256 | 12/1990 |
| JP | 11 339100 | 12/1999 |
| JP | 2002 279487 | 9/2002 |

*Primary Examiner* — David H Bollinger

(74) *Attorney, Agent, or Firm* — Oblon, Spivak, McClelland, Maier & Neustadt, L.L.P.

(57) ABSTRACT

A paper sheet processing apparatus capable of preventing paper sheet clogging in a traveling route in which a paper sheet is conveyed is provided. The paper sheet processing apparatus comprises an open/close member 2B which is opened or closed with respect to a frame 2A and a traveling route through which the paper sheet (a bill, a card, a coupon ticket, and the like are collectively referred to as "paper sheet") is conveyed is formed between the open/close member 2B and the frame 2A when the open/close member 2B is closed with respect to the frame 2A. The open/close member 2B is provided with a sensor 31 for detecting that the open/close member 2B is opened from the frame 2A.

12 Claims, 13 Drawing Sheets

PAPER SHEET PROCESSING DEVICE

FIELD OF THE INVENTION

The present invention relates to a paper sheet processing apparatus (or device) which carries bills, cards, coupon tickets, and so on (hereafter collectively referred to as "paper sheet") having been inserted from an insertion slot and conducts authenticity judgment process thereof.

BACKGROUND ART

In general, a bill processing apparatus, which is one of the embodiments of the paper sheet processing apparatus, is incorporated into a service device such as a game medium rental machine installed in a game hall, an automatic vending machine or a ticket-vending machine installed in a public space, or the like which judges authenticity of a bill inserted from an insertion slot by a user and provides products and services in accordance with a value of the bill having been authenticated. This type of paper sheet processing apparatus comprises a traveling route through which the bill having been inserted into the insertion slot is conveyed and a conveyance mechanism which is disposed along the traveling route so as to carry the bill.

The above-mentioned traveling route may be, as disclosed in Patent Document 1, for example, configured to be able to open in view of ease of maintenance or the like. In the bill processing apparatus disclosed in Patent Document 1, a lower casing is provided and a shaft is fixed to an end portion of the lower casing, and an upper casing is supported rotatably around the shaft and attached thereto in a freely mountable-and-demountable manner, a traveling route is formed between the lower casing and the upper casing. Therefore, the traveling route can be exposed outside by turning the upper casing with respect to the lower casing.

[Patent Document 1] Japanese unexamined patent application publication No. 2002-279487

DISCLOSURE OF THE INVENTION

Problem to be Solved by the Invention

In the bill processing apparatus disclosed in Patent Document 1, the upper casing could be insufficiently mounted to the lower casing in some occasion.

Means to Solve the Problem

In the present invention, a paper sheet processing apparatus comprises an open/close member to be opened or closed with respect to a frame wherein a traveling route through which a paper sheet is conveyed is formed between the frame and the open/close member when the open/close member is closed over the frame and may further comprise a sensor which detects that the open/close member gets released from the frame. Further features of the present invention, its nature, and various advantages will be more apparent from the accompanying drawings and the following description of the preferred embodiment

DESCRIPTION OF NOTATIONS

Figure 1:
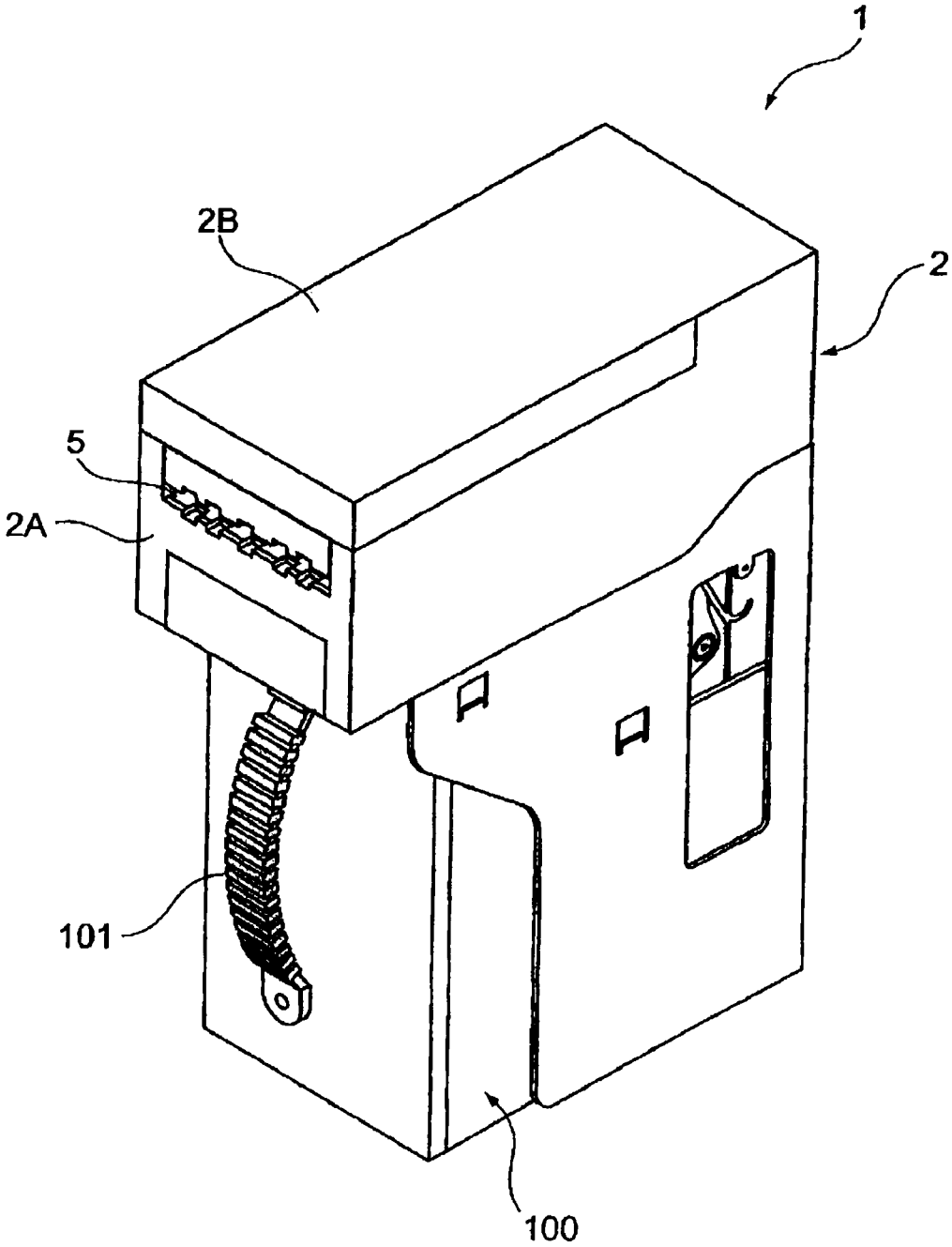
FIG. 1 is a perspective view showing an entire structure to illustrate a configuration of a bill processing apparatus of this embodiment.

1 bill processing apparatus
2 apparatus main body
2A frame
3 bill traveling route
5 bill insertion slot
6 bill conveyance mechanism
8 bill reading means
10 skew correction mechanism
30 detection means
31 sensor (open/close member detecting sensor)
32 detecting member
32*a* detecting part
32*b* touching part
100 bill housing part
200 control means

BEST MODE FOR CARRYING OUT THE INVENTION

Figure 5:
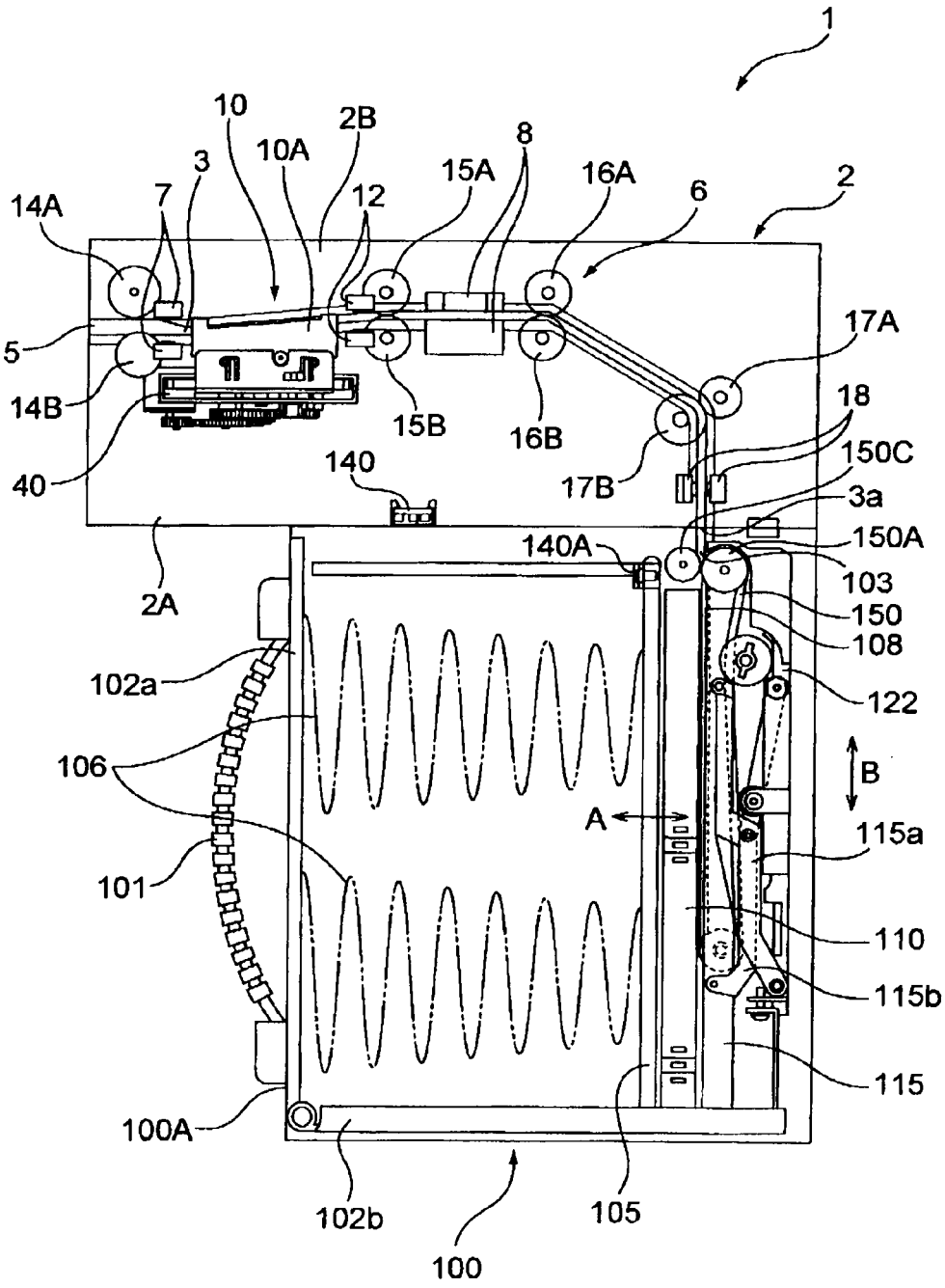
FIG. 5 is a right side view schematically showing a traveling route of the bill to be inserted from an insertion slot.
Figure 6:
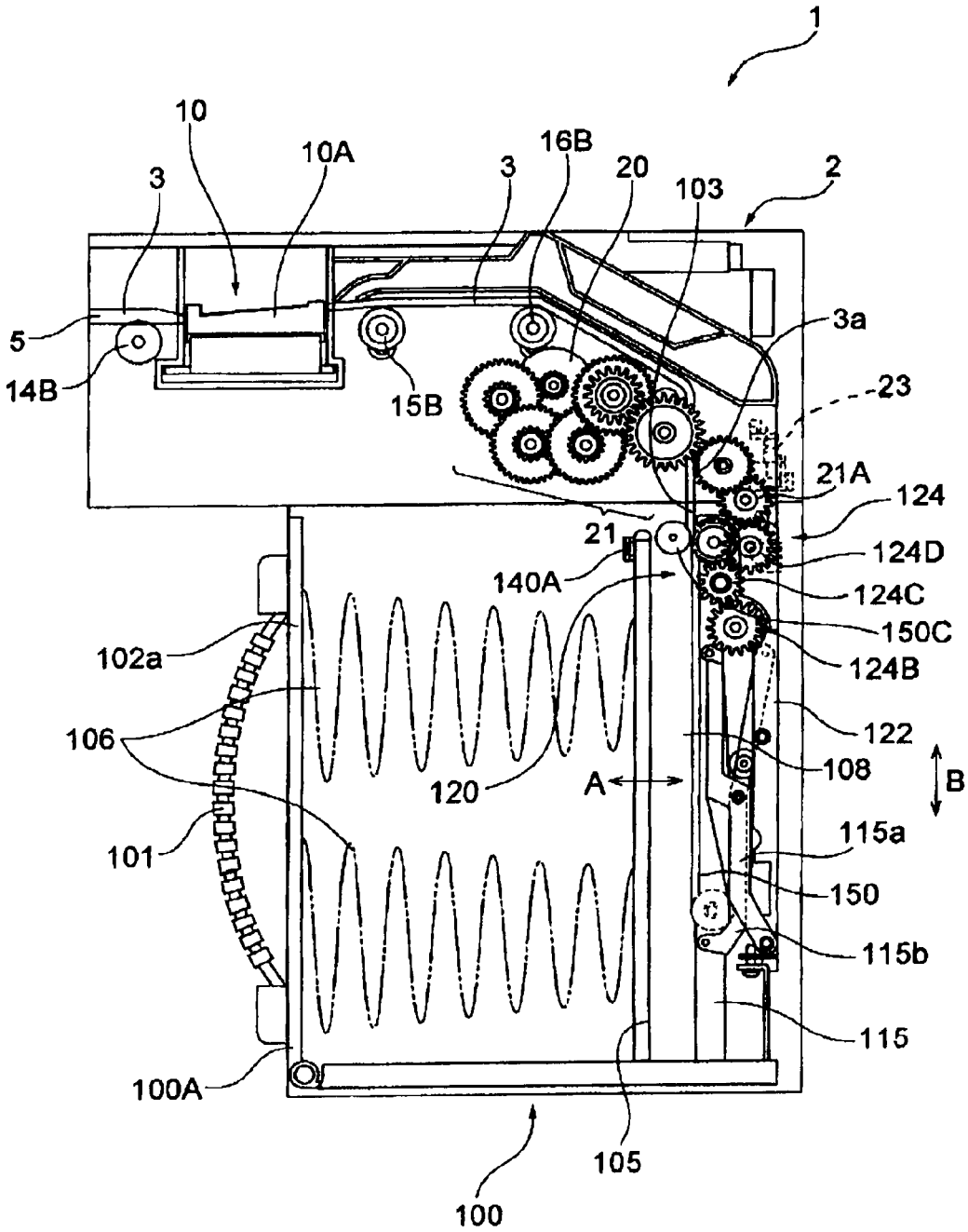
FIG. 6 is a view showing a schematic configuration of a power transmission mechanism for driving a presser plate arranged in a bill housing part.
Figure 7:
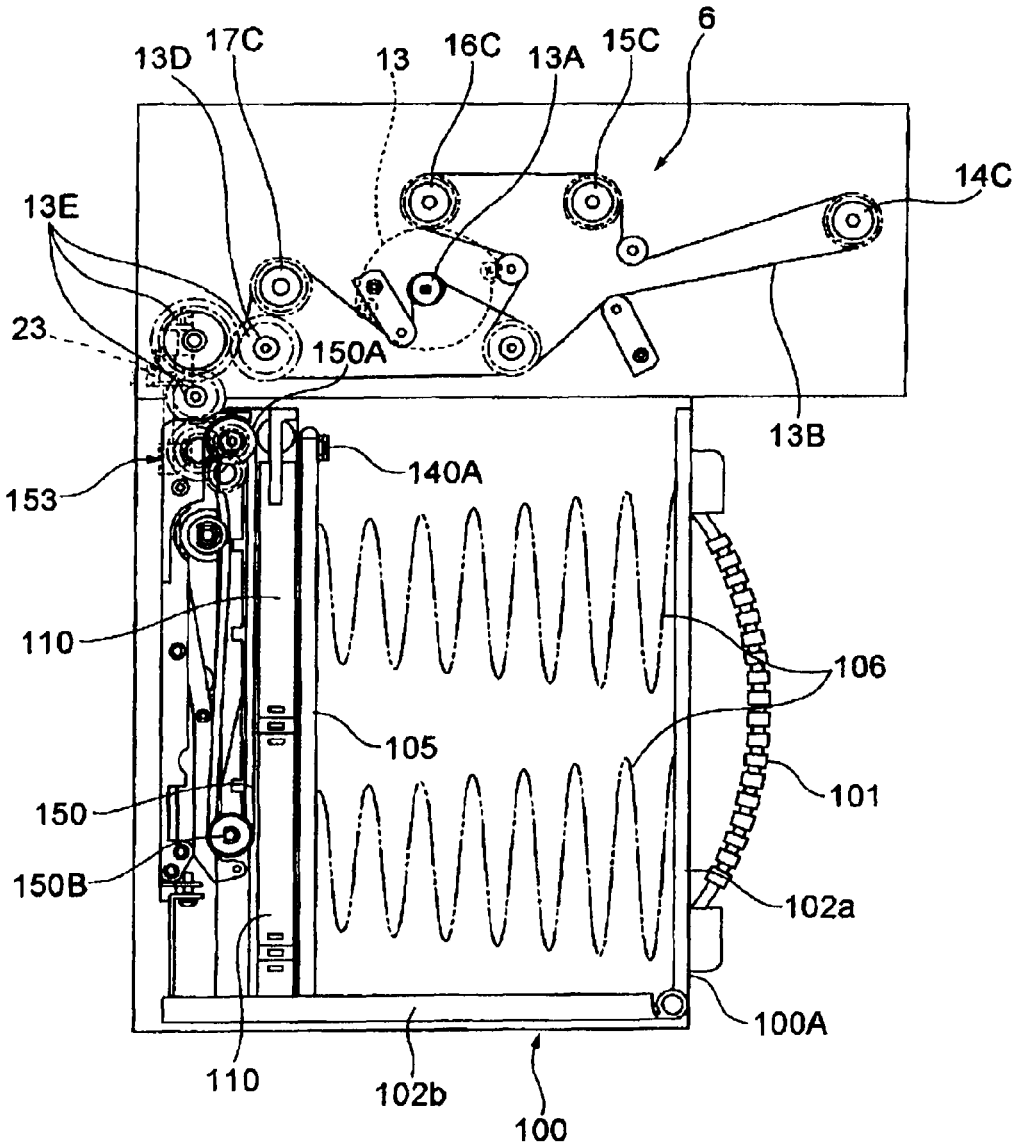
FIG. 7 is a left side view showing a schematic configuration of a driving source and a driving force transmission mechanism to drive a bill conveyance mechanism.

First, an entire configuration of a bill processing apparatus, as one embodiment of a paper sheet processing apparatus according to the present invention, will be described with reference to FIGS. 1 to 7. In addition, among these drawings, FIG. 1 is a perspective view showing an entire configuration, FIG. 2 is a perspective view showing a state that an open/close member is opened with respect to a frame of an apparatus main body, FIG. 3 is a perspective view showing the interior configuration of the open/close member attached rotatably to a main body frame of the apparatus main body, FIG. 4 is a perspective view showing the open/close member from the back side, FIG. 5 is a right side view schematically showing a traveling route for a bill to be inserted from an insertion slot, FIG. 6 is a view showing a schematic configuration of a power transmission mechanism for driving a presser plate installed in a bill housing part, and FIG. 7 is a left side view showing a driving source and a driving force transmission mechanism for driving a bill conveyance mechanism.

A bill processing apparatus 1 of this embodiment is configured to be incorporable into, for example, various types of game machines such as a slot machine and the like, and the bill processing apparatus 1 comprises an apparatus main body 2 and a bill housing part (e.g., bill housing stacker) 100 which is provided on the apparatus main body 2, and is capable of laminating and housing a great number of bills. The bill housing part 100 has a function as a safe and is configured to be mountable to and demountable from a frame 2A constituting the apparatus main body 2. In this embodiment, for example, it is possible to remove the bill housing part 100 from the frame 2A of the apparatus main body 2 by pulling a handle 101 fixed to a front face thereof in a state that a lock mechanism (not shown) is unlocked.

Figure 2:
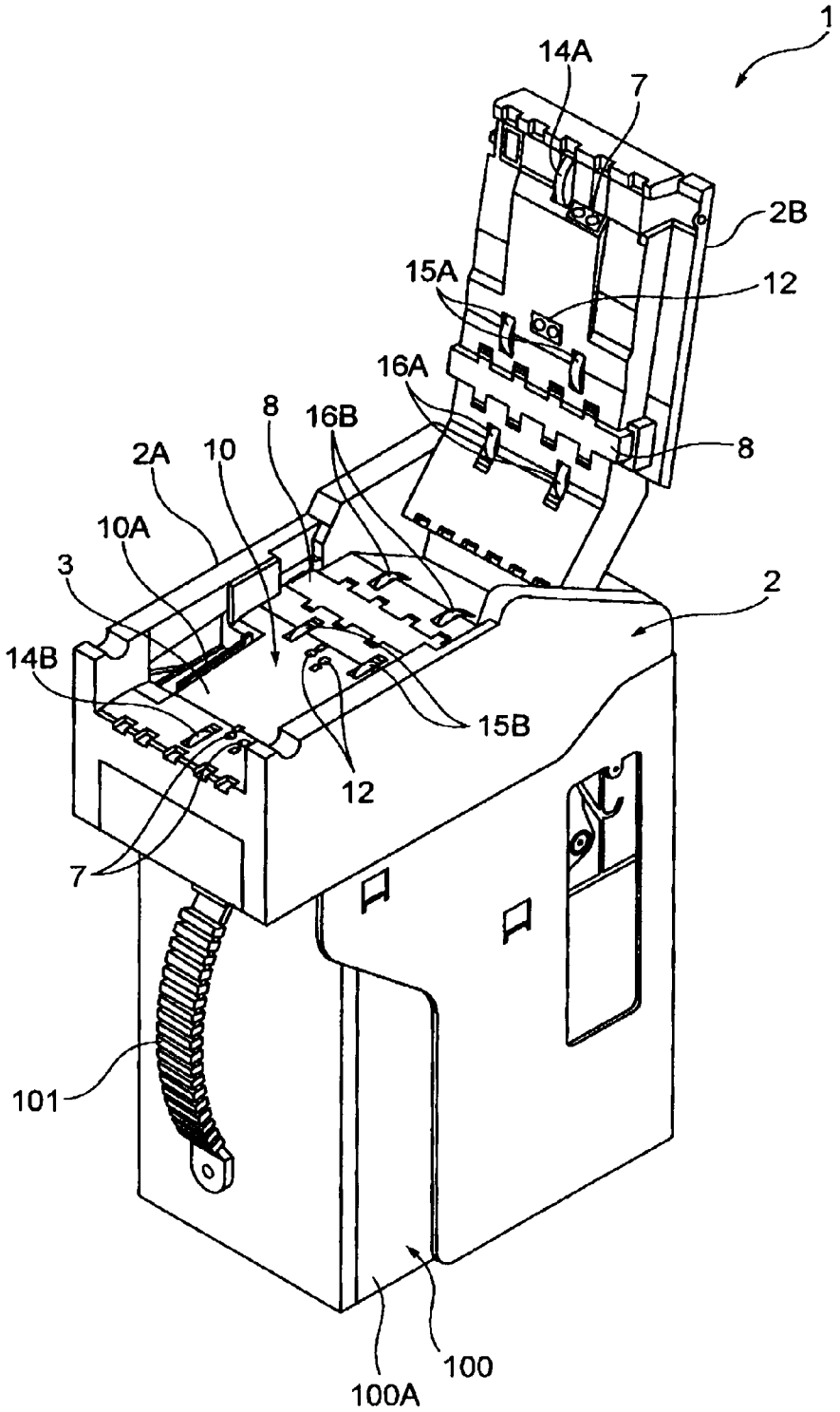
FIG. 2 is a perspective view showing the bill processing apparatus in a state that an open/close member is opened for a frame of an apparatus main body.
Figure 3:
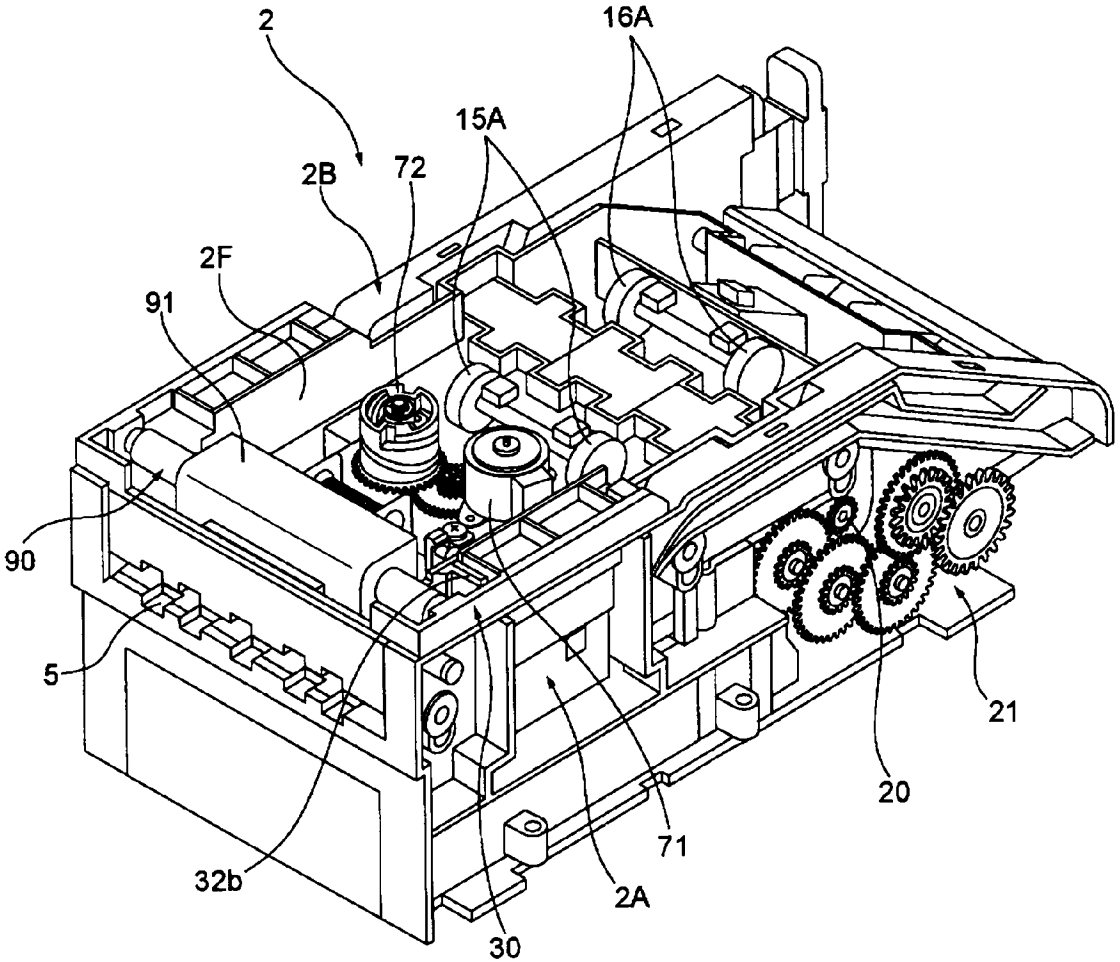
FIG. 3 is a perspective view showing an interior configuration of the open/close member installed in a main body frame of the apparatus main body.
Figure 4:
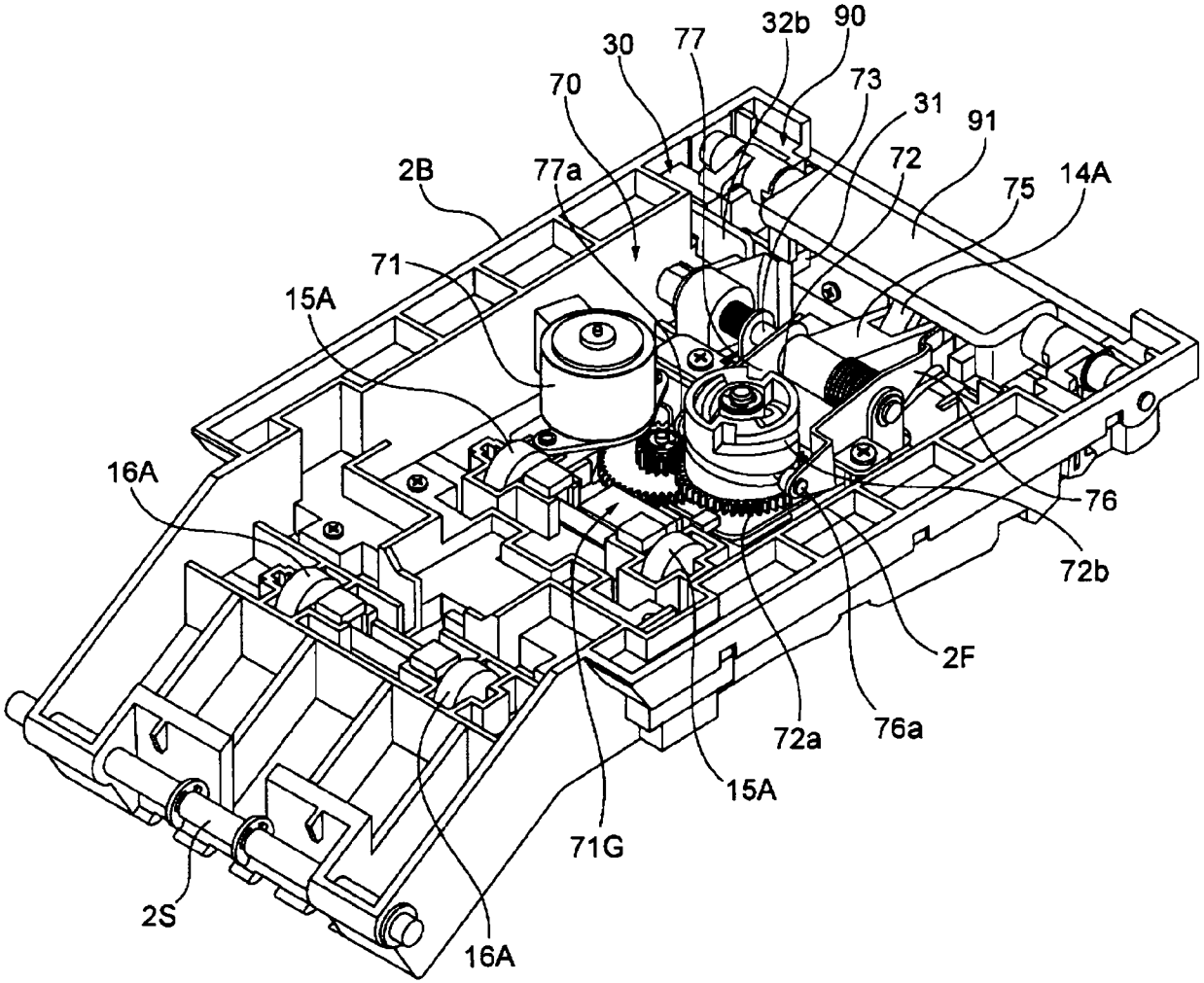
FIG. 4 is a perspective view showing the open/close member from the back.

As shown in FIGS. 2 to 4, the apparatus main body 2 comprises the frame 2A and an open/close member 2B configured to be opened and closed by rotation thereof around an axis 2*s* fixed on one side of the frame 2A. The open/close member 2B is locked with respect to the frame 2A by a lock mechanism 90 on an opposite side to the axis 2*s*, and the locked state of the lock mechanism 90 is released by lifting and turning a rotary piece 91 constituting the lock mechanism 90 such that the open/close member 2B may be opened with respect to the frame 2A. In addition, the open/close member 2B is configured as a casing including an interior space, and FIGS. 3 and 4 show a state that a top cover is removed so as to show an interior configuration.

Further, detection means 30 which detects that the open/close member 2B is released (or opened) from the frame 2A is installed inside the open/close member 2B.

As shown in FIG. 5, the frame 2A and the open/close member 2B are configured to form a space (bill traveling route) 3 through which a bill is conveyed such that both face each other across the space when the open/close member 2B is closed for the frame 2A, and to form a bill insertion slot 5 such that front exposed faces of both are aligned and that the bill traveling route 3 exits at the bill insertion slot 5.

In the apparatus main body 2, a bill conveyance mechanism 6 that conveys a bill; an insertion detecting sensor 7 that detects the bill inserted into the bill insertion slot 5; bill reading means 8 that is installed on a downstream side of the insertion detecting sensor 7 and reads information from the bill in a travelling sate; a skew correction mechanism 10 that accurately positions and conveys the bill with respect to the bill reading means 8; a movable piece passage detecting sensor 12 that detects that the bill passes through movable pieces constituting the skew correction mechanism 10; a discharge detecting sensor 18 that detects that the bill is discharged into the bill housing part 100; a presser plate detecting sensor 23 capable of detecting a position of a presser plate 115 pressing the bill toward a placing plate 105 in the bill housing part 100; and control means 200 (a control circuit board 200A; refer to FIG. 12) for controlling the driving of the above-mentioned bill conveyance mechanism 6, the bill reading means 8, the skew correction mechanism 10, and the like are provided.

Hereafter, the respective components described above will be described in detail.

The bill traveling route 3 is extended from the bill insertion slot 5 toward the back side, and is formed to be bent so as to be inclined downward on a rear side thereof, and to be eventually bent in the vertical direction.

A discharge slot 3*a* from which the bill is discharged to the bill housing part 100 is formed in the bill traveling route 3, and the bill discharged therefrom is fed into a feed port (receiving port) 103 of the bill housing part 100 in the vertical direction.

The bill conveyance mechanism 6 is a mechanism capable of carrying the bill inserted from the bill insertion slot 5 along the insertion direction, and of carrying back the bill in an insertion state toward the bill insertion slot 5. The bill conveyance mechanism 6 comprises a motor 13 (refer to FIG. 7) serving as a driving source installed in the apparatus main body 2; and conveyor roller pairs (14A and 14B), (15A and 15B), (16A and 16B), and (17A and 17B) which are installed at predetermined intervals along the bill traveling direction in the bill traveling route 3, and are driven to rotate by the motor 13.

The conveyor roller pairs are installed so as to be partially exposed on the bill traveling route 3, and all the pairs are constituted of driving rollers of the conveyor rollers 14B, 15B, 16B, and 17B installed on the underside of the bill traveling route 3 driven by the motor 13; and pinch-rollers of the conveyor rollers 14A, 15A, 16A, and 17A installed on the upperside and driven by the these driving rollers. In addition, the conveyor roller pair (14A and 14B) to first nip and hold therebetween the bill inserted from the bill insertion slot 5, and to carry the bill toward the back side, as shown in FIG. 2, is installed in one portion of the center position of the bill traveling route 3, and a couple of the conveyor roller pairs (15A and 15B), (16A and 16B), or (17A and 17B) being disposed in this order on the downstream side thereof are respectively installed in a couple of portions with a predetermined interval in the lateral direction of the bill traveling route 3.

Further, the conveyor roller pair (14A and 14B) disposed in the vicinity of the bill insertion slot 5 is usually in a state that the upper conveyor roller 14A is spaced from the lower conveyor roller 14B, and the upper conveyor roller 14A is driven to move toward the lower conveyor roller 14B to nip and hold the inserted bill therebetween when insertion of the bill is sensed by the insertion detecting sensor 7. In addition, the upper conveyor roller 14A is controllably driven to be pressed against or spaced from the conveyor roller 14B by a conveyor roller driving source 70 as shown in FIG. 4.

The conveyor roller driving mechanism 70 comprises a motor 71 serving as a driving source and a cylindrical cam member 72 which is arranged next to the motor 71 and supported rotatably. An output gear is attached to the output shaft of the motor 71, and the output gear is connected to an input gear 72*a* integrally attached to the cam member 72 via a gear train 71G. Therefore, the above-mentioned cam member 72 is driven to rotate normally/reversely via the gear train 71G by the rotational driving of the motor 71. Here, a spiral groove (grooved cam) 72*b* is formed in the outer circumferential surface of the above-mentioned cam member 72.

A support shaft 73 extending in a direction perpendicular to the bill traveling direction is provided on the bill insertion slot side in a frame 2F of the open/close member 2B. An arm 75 extending toward the bill insertion slot side is supported rotatably at the substantially center of the support shaft 73, and the above-mentioned roller 14A is supported rotatably at the leading end thereof. Then, a pair of swing members 76 and 77 are supported with respect to the support shaft 73 on both sides of the arm 75 so as to turn the arm 75 around the support shaft 73.

The above-mentioned pair of swing members 76, 77 extend toward the cam member 72 side, and projections 76*a*, 77*a* to be engaged with the above-mentioned groove 72*b* are formed at respective top ends of the swing members 76, 77. Therefore, when the above-mentioned cam member 72 is rotationally driven to rotate by rotational driving of the motor 71, the swing members 76, 77 are swung in an up-and-down direction in synchronization.

Then, when a process (skew correction process) for positioning the bill with respect to the bill reading means 8 by eliminating tilt of the inserted bill is executed by the skew correction mechanism 10, the upper conveyor roller 14A is spaced from the lower conveyor roller 14B so as to release the load on the bill, and when the skew correction process is completed, the upper conveyor roller 14A is driven to move toward the lower conveyor roller 14B again to hold (or nip) the bill therebetween. The skew correction mechanism 10 comprises a pair of right and left movable pieces 10A (only one side is shown) that perform skew correction and the skew correction process is performed by driving a motor 40 for a skew driving mechanism.

The conveyor rollers 14B, 15B, 16B and 17B installed on the underside of the bill traveling route 3 are, as shown in FIG. 7, driven to rotate via the motor 13 and pulleys 14C, 15C, 16C, and 17C installed at the ends of the driving shafts of the respective conveyor rollers. That is, a driving pulley 13A is installed on the output shaft of the motor 13, and a driving belt 13B is wrapped around between the pulleys 14C, 15C, 16C, and 17C installed at the ends of the driving shafts of the respective conveyor rollers and the driving pulley 13A. In addition, tension pulleys are engaged in places with the driving belt 13B, which prevents the driving belt 13B from loosening.

In accordance with the configuration described above, when the motor 13 is driven to normally rotate, the conveyor rollers 14B, 15B, 16B, and 17B are driven to normally rotate in synchronization therewith to carry the bill toward the insertion direction. When the motor 13 is driven to reversely rotate, the conveyor rollers 14B, 15B, 16B, and 17B are driven to reversely rotate in synchronization therewith to carry back the bill toward the bill insertion slot 5 side.

The insertion detecting sensor 7 is to generate a detection signal when a bill inserted into the bill insertion slot 5 is detected. In this embodiment, the insertion detecting sensor 7 is installed between the pair of conveyor rollers (14A and 14B) and the skew correction mechanism 10. The insertion detecting sensor 7 comprises, for example, an optical sensor such as a regressive reflection type photo sensor. However, the insertion detecting sensor 7 may comprise a mechanical sensor other than the optical sensor.

Further, the movable piece passage detecting sensor 12 is to generate a sensed signal when it is sensed that a front end of the bill passes through a pair of right and left movable pieces 10A constituting the skew correction mechanism 10, and the movable piece passage detecting sensor 12 is installed on the upstream side of the bill reading means 8. The movable piece passage detecting sensor 12 also comprises an optical sensor or a mechanical sensor in the same way as mentioned before with respect to the insertion detecting sensor.

Further, the discharge detecting sensor 18 is to detect a back end of the bill passing through such that it is detected that the bill is discharged into the bill housing part 100. The discharge detecting sensor 18 is disposed just in front of the receiving port 103 of the bill housing part 100 on the downstream side of the bill traveling route 3. The discharge detecting sensor 18 also comprises an optical sensor or a mechanical sensor in the same way as the aforementioned insertion detecting sensor.

The bill reading means 8 reads bill information on the bill conveyed in a state that the skew is eliminated by the skew correction mechanism 10 (in a state that the bill is accurately positioned), and judges whether the bill is true or false. In detail, for example, the bill reading means 8 may comprise a line sensor that performs reading of the bill such that a bill to be conveyed is irradiated with light from upper and lower sides, and transmitted light therethrough and reflected light therefrom are detected by a light receiving element. A line sensor is shown in the drawing, and an optical signal read by the line sensor is photoelectric-converted, and the signal is compared and checked with data of a legitimate bill stored in advance, which makes it possible to identify the authenticity of the bill to be conveyed.

The bill housing part 100 that houses bills is so configured as to be mountable to and demountable from the frame 2A of the apparatus main body 2, and to house and stack sequentially the bills identified as being genuine by the bill reading means 8.

The main body frame 100A constituting the bill housing part 100 is formed into a substantially rectangular parallelepiped (or cuboid) shape, and one end of bias means (e.g., bias spring) 106 is attached to an interior side of a front wall 102*a* thereof, and a placing plate 105 on which bills to be fed via the above-described receiving port 103 are sequentially stacked is provided to the other end thereof. Therefore, the placing plate 105 is in a state that it is pressed toward the presser plate 115, which will be described later, by the bias means 106.

In the main body frame 100A, a press standby part 108 that keeps a dropping bill as it falls is provided so as to continuously communicate with the receiving port 103. A pair of regulatory members 110 (only one of the pair is shown in FIG. 5) are disposed on both sides of the press standby part 108, respectively, the regulatory blocks 110 extending in a vertical direction. The pair of regulatory members 110 take a holding role to hold the stacked bills stably by contacting both sides of a surface of an uppermost bill of the stacked bills when bills are sequentially stacked on the placing plate 105 and the placing plate 105 is biased by the biasing means 106.

Further, the presser plate 115 that presses toward the placing plate 105 a bill falling into the press standby part 108 from the receiving port 103 is installed in the main body frame 100A. The presser plate 115 is formed in such a size that it may be capable of reciprocating through an opening formed between the pair of regulatory members 110 and is driven to reciprocate between a position where the bills are pressed against the placing plate 105 and another position where the press standby part 108 is opened.

The presser plate 115 is driven to reciprocate as described above via a presser plate driving mechanism 120 installed in the main body frame 100A. The presser plate driving mechanism 120 comprises a pair of link members 115*a* and 115*b* having respective ends thereof supported pivotally by the presser plate 115 so as to allow the presser plate 115 to reciprocate in an arrow A direction in FIG. 6, and these link members 115*a* and 115*b* are connected in a shape of letter "X", and the other ends opposite to the respective ends are supported pivotally by a movable member 122 installed movably in a vertical direction (an arrow B direction). A rack 122A is formed in the movable member 122 along an arrow B direction, and a pinion constituting the presser plate driving mechanism 120 is geared (engaged) with the rack (the pinion is disposed coaxially with the gear 124B in FIG. 6).

As shown in FIG. 6, a housing part side gear train 124 constituting the presser plate driving mechanism 120 is connected to the pinion. In this case, in this embodiment, as shown in FIGS. 3 and 6, a driving source (a motor 20) and a main body side gear train 21 sequentially engaged with the motor 20 are installed in the above-described apparatus main body 2, and when the bill housing part 100 is mounted to the apparatus main body 2, the main body side gear train 21 is to be connected to the housing part side gear train 124. The housing part side gear train 124 comprises a gear 124B installed on the same axis of the pinion 124A and gears 124C, 124D to be engaged sequentially with the gear 124B, and when the bill housing part 100 is mounted to and demounted from the apparatus main body 2, the gear 124D is configured to be engaged with and disengaged from a final gear 21A of the main body side train 21.

As a result therefrom, the presser plate 115 is driven to reciprocate in the arrow A direction as the motor 20 installed in the apparatus main body 2 is driven to rotate so as to drive the main body side train 21 and in turn the presser plate driving mechanism 120 (the housing part side gear train 124, the rack installed onto the movable member 122, and the link members 115*a*, 115*b*, etc.).

In the frame 2A of the main body 2, as shown in FIG. 4, a detecting sensor (full detecting sensor) 140 that detects the state when a predetermined number of bills are placed on the placing plate 105 is installed. The full detecting sensor is configured to be capable of detecting a magnetic signal, and is configured to be capable of detecting a magnetic field by a magnet 140A provided at a center on the rear surface of the placing plate 105. That is, the full detecting sensor 140 is installed at a predetermined position in a direction in which the placing plate 105 is pushed back, bills are sequentially placed on the placing plate 105 such that the placing plate 105 is pushed back against the bias force of the bias means 106, and the full detecting sensor 140 outputs a signal indicating that the bills on the placing plate 105 are full when the full detecting sensor 140 detects a backward movement of the placing plate 105.

Conveyor members 150 which are capable of touching the bill conveyed-in from the receiving port 103 are installed in the main body frame 100A. The conveyor members 150 take their own role to contact the bill conveyed-in so as to stably guide the bill to an appropriate position in the press standby part 108 (position where the bill can be stably pressed without causing the bill to be moved to the right or left side when the bill is pressed by the presser plate 115). In this embodiment, the conveyor members are constituted of belt-like members (hereafter called belts 150) installed so as to face the press standby part 108.

In this case, the belts 150 are installed so as to extend along the conveying-in direction with respect to the bill, and are wrapped around the pair of pulleys 150A and 150B supported rotatably on both ends in the conveying-in direction. Further, the belts 150 contact a conveyor roller 150C extending in an axis direction which is supported rotatably in the region of the receiving port 103, and the belts 150 and the conveyor roller 150C nip and hold the bill conveyed-in the receiving port 103 therebetween to guide the bill directly to the press standby part 108. Here, in this embodiment, the pair of belts 150 are provided on the right and left sides, respectively, across the above-described presser plate 115 in order to be capable of contacting the surface on left and right sides of the bill. Also, the belts 150 may be prevented from loosening by not only being wrapped around the pulleys 150A and 150B at the both ends, but also causing tension pulleys to push the belts 150 at the intermediate positions, respectively.

The pair of belts 150 are configured to be driven by the motor 13 that drives the above-described plurality of conveyor rollers installed in the apparatus main body 2. In detail, as shown in FIG. 7, the above-described driving belt 13B driven by the motor 13 is wrapped around a pulley 13D for the driving force transmission, and a gear train 153 installed at the end of the spindle of the pulley 150A supported rotatably on the receiving port 103 side is engaged with a gear train 13E for the power transmission sequentially installed onto the pulley 13D. That is, when the bill housing part 100 is mounted to the apparatus main body 2, an input gear of the gear train 153 is configured to be engaged with a final gear of the gear train 13E, and the pair of belts 150 are configured to be driven to rotate in a synchronized manner with the above-described conveyor rollers 14B, 15B 16B, and 17B for conveying the bill by driving the motor 13 to rotate.

Also, the above-mentioned presser plate detecting sensor 23 is configured to be capable of detecting a position of the presser plate 115 that presses the bill toward the placing plate 105, and further, to be capable of detecting the mounting or demounting operation when the bill housing part 100 is mounted to or demounted from the frame 2A of the apparatus main body 2.

Next, a configuration of detection means 30, being disposed inside the open/close member 2B, which detects that the open/close member is opened from the frame 2A with reference to FIGS. 8 to 11C.

Figure 8:
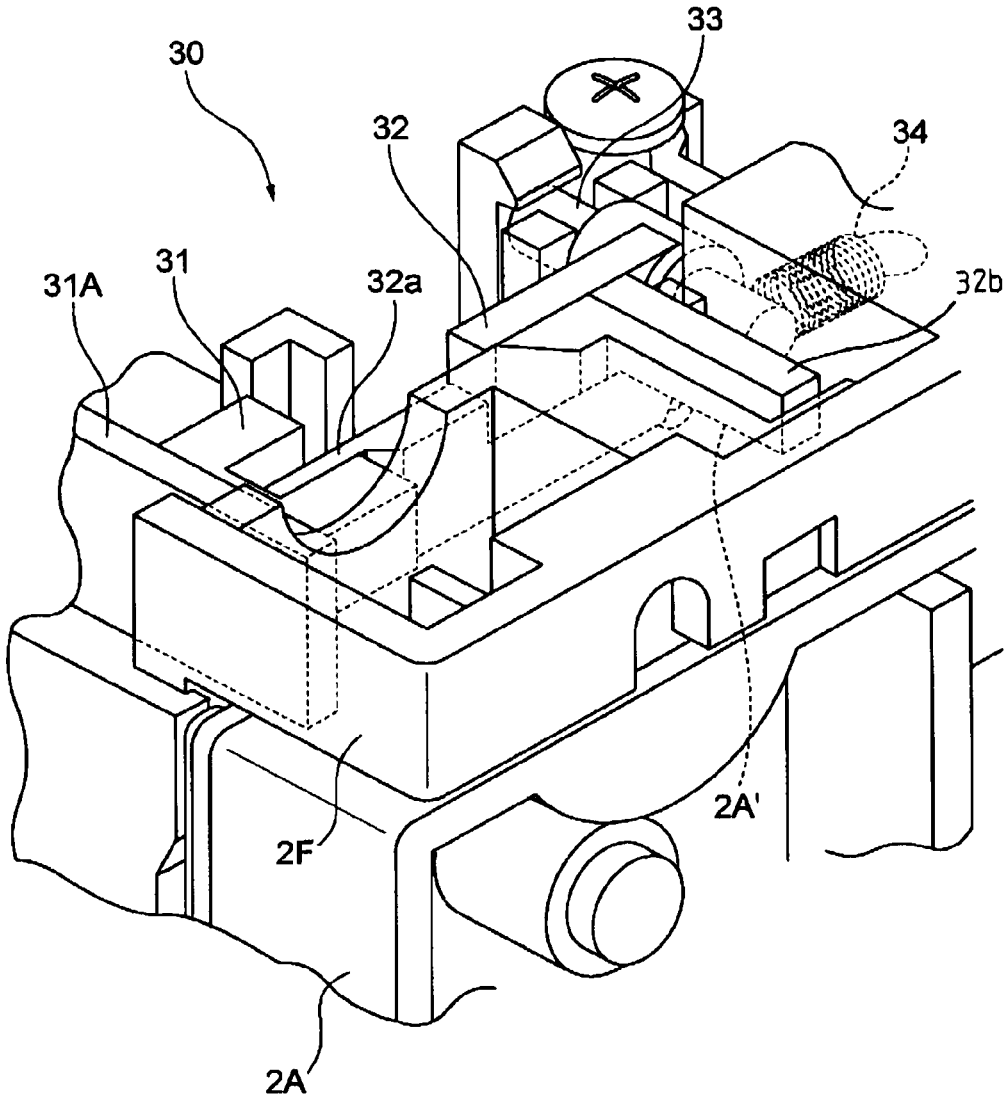
FIG. 8 is an enlarged perspective view showing a schematic configuration of a principal part of FIGS. 3 and 4. In a state that an open/close member 2B is closed over an apparatus main body 2.
Figure 9A:
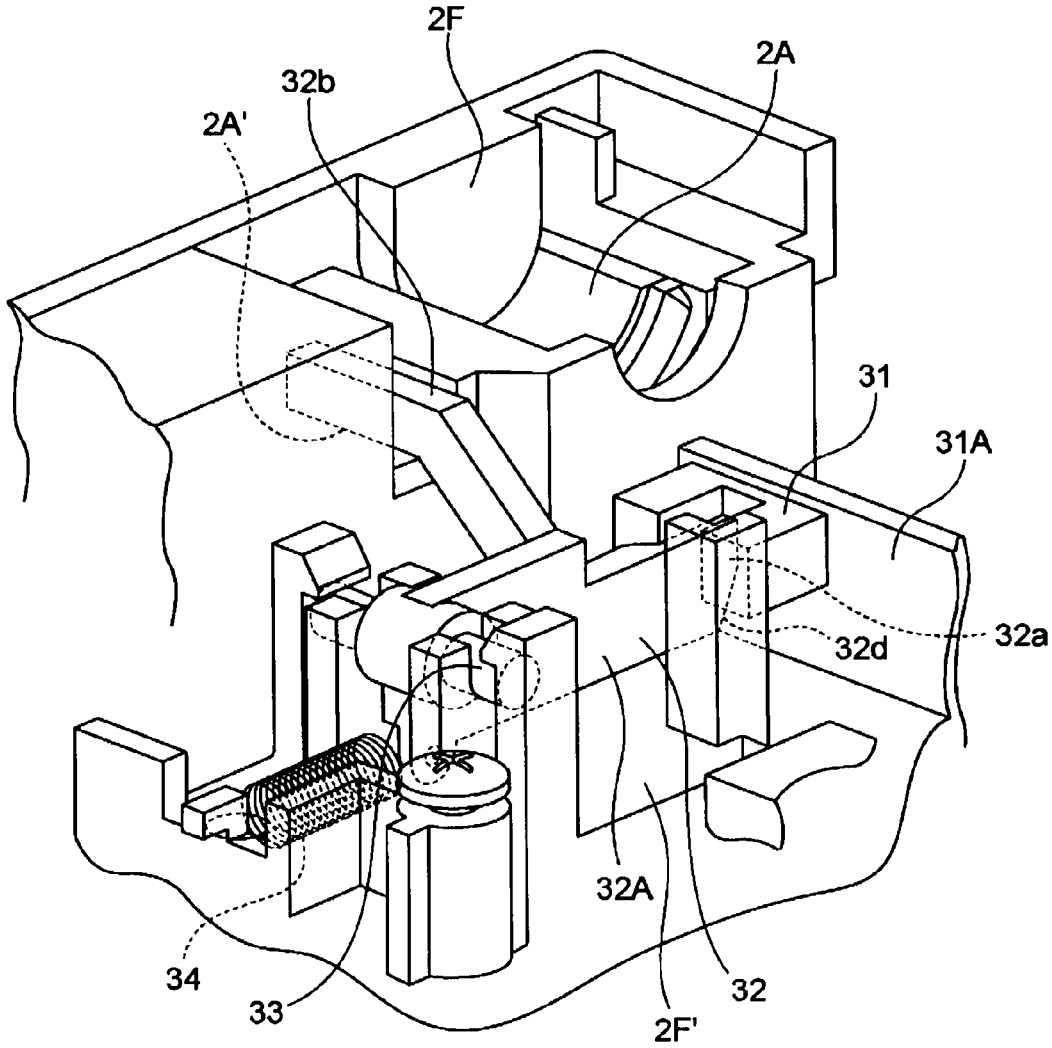
FIG. 9A is a perspective view showing detection means from inside. In a state that the open/close member 2B is open for the apparatus main body 2.
Figure 9B:
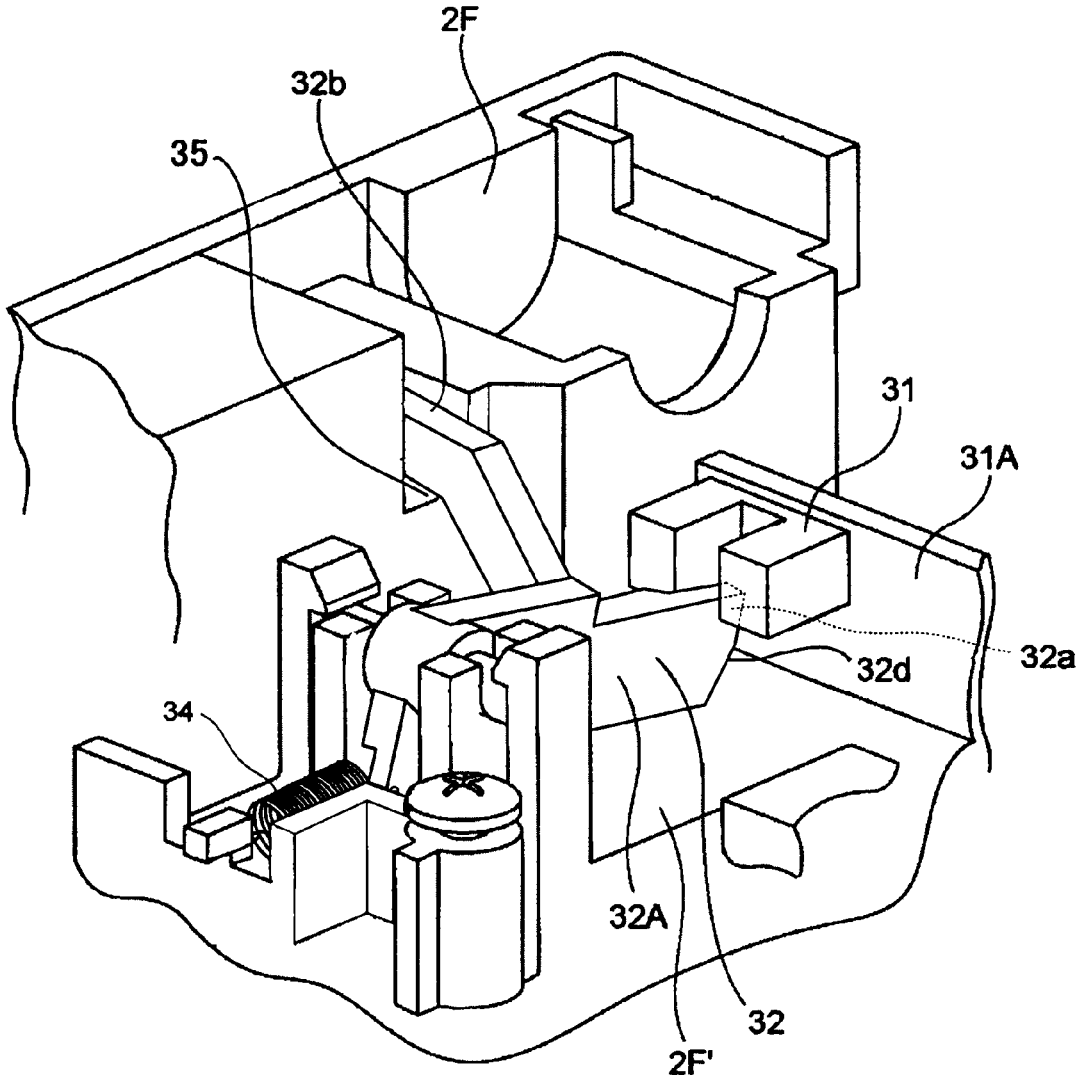
FIG. 9B is a perspective view showing detection means from inside.
Figure 10:
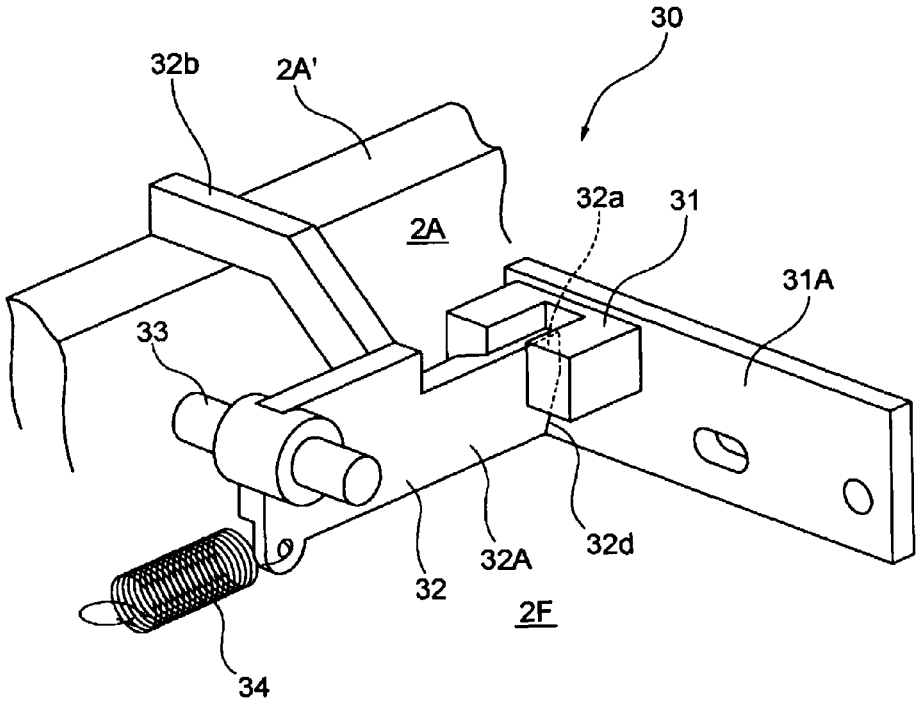
FIG. 10 is a perspective view showing a configuration of the detection means.
Figure 11A:
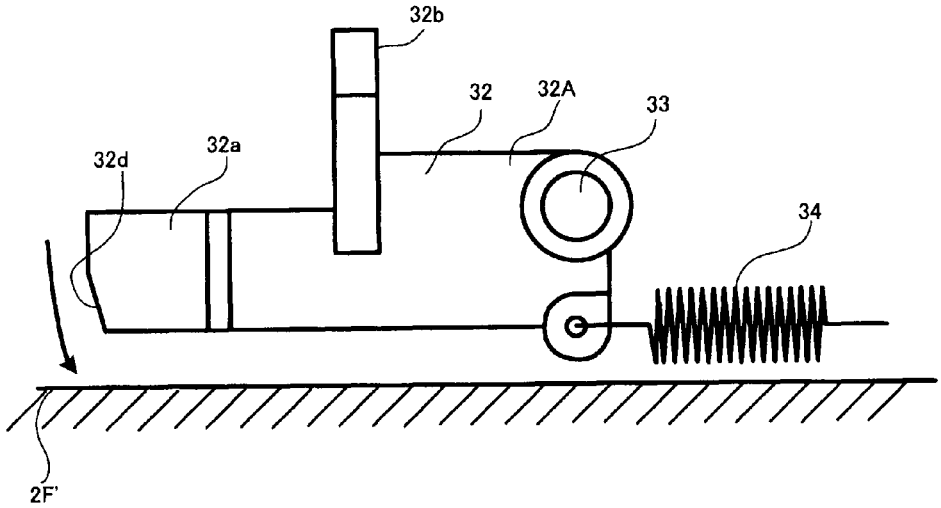
FIG. 11A is a side view showing a configuration of a detecting member constituting the detection means in a closed state.
Figure 11B:
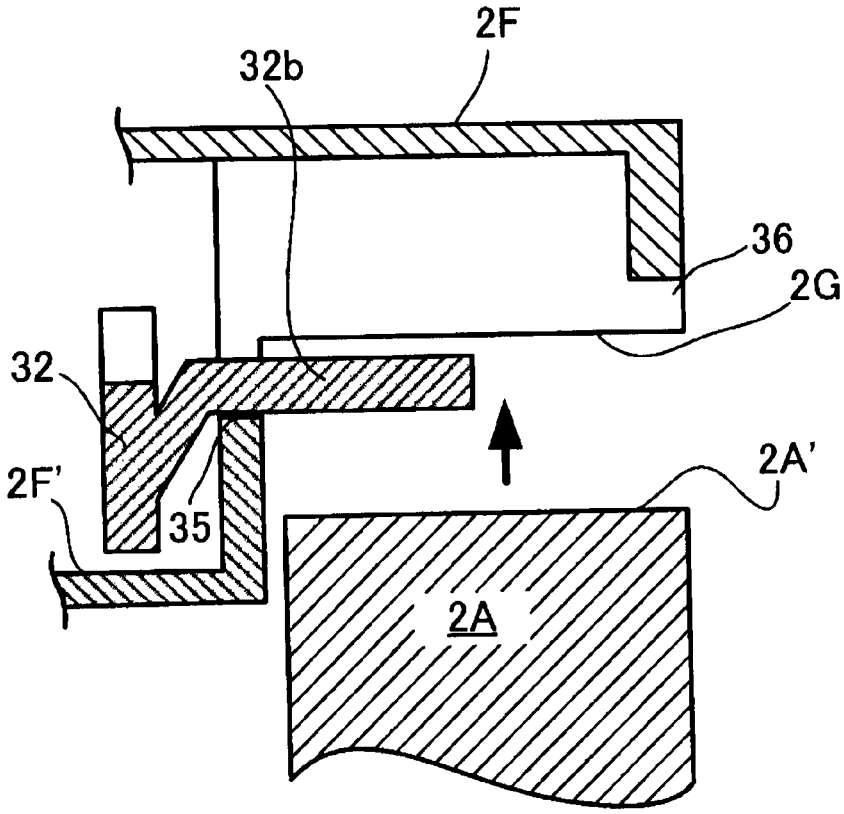
FIG. 11B is a cross section view showing a state that the detecting member is stopped by engagement in an opened state.
Figure 11C:
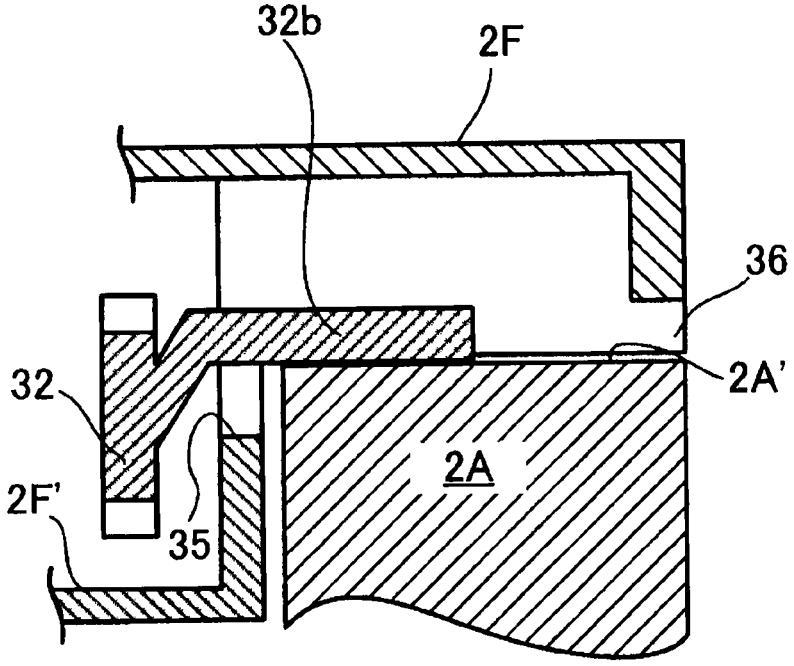
FIG. 11C is a cross section view showing a state that the detecting member contacts an opposed face.

Among these drawings, FIG. 8 is an enlarged perspective view of a principal part of FIGS. 3 and 4, FIG. 9 is a perspective view of the detection means viewed from the inside, FIG. 10 is a perspective view showing a configuration of the detection means, and FIG. 11A is a side view showing a configuration of a detecting member constituting the detection means, FIG. 11B is a cross section view showing a state that the detecting member is stopped by engagement in a released (or opened) state, and FIG. 11C is a cross section view showing a state that the detecting member contacts an opposed face in a closed state. In addition, in FIGS. 8, 9A, and 9B, the lock mechanism 90 that locks the open/close member 2B shown in FIGS. 3 and 4 is omitted.

The detection means 30 is installed on the end portion opposite to the axis 2S rotatably supporting the frame 2F constituting the open/close member 2B, and comprises a sensor (open/close member detecting sensor) 31 which is mounted to a sensor substrate 31A mounted onto an interior wall of the front end side of the frame 2F and a detecting member 32 to rotate based on the opening-and-closing operation of the open/close member 2B. The sensor 31 is configured as an optical sensor including a light-receiving part and a light-emitting part, and is configured to detect that the open/close member 2B is opened as the light-receiving and light-emitting parts detect a movement of the leading end (detecting part 32*a*) of the detecting member 32.

The above-mentioned detecting member 32 is configured to be substantially plate-like, and the detecting part 32*a* detected by the sensor 31 is formed at one end side thereof while the other end side thereof is supported rotatably around a support shaft 33 with respect to the frame 2F of the open/close member 2B. Further, the detecting member 32 is in a state of being biased by a tension spring 34 that is stretched between a portion of the detecting member 32 lower than the support shaft 33 and the frame 2F such that the detecting part 32*a* on the front end of the detecting member 32 is always biased to turn in a downward direction around the support shaft 33 as indicated by an arrow shown in FIG. 11A. To describe it more in detail, the detecting member 32 forms a standing plate (wall) in the open/close direction of the open/close member 2B and comprises a main body 32A extending in a front-back direction of the open/close member 2B. And a back end portion of the detecting member 32 is fixed to the support shaft such that the detecting part 32*a* at the leading edge thereof can pass through between the light-receiving part and the light-emitting part by turning.

Also, a touching part 32*b* is formed on the detecting member 32 so as to contact an opposed face 2A' of the frame 2A facing the open/close member 2B when the open/close member 2B is closed onto the frame 2A of the apparatus main body 2. The touching part 32*b* extends in an arm shape from the main body 32A of the detecting member 32, and when the open/close member 2B is closed onto the frame 2A of the apparatus main body 2, the touching part 32*b* contacts the opposed face 2A' to prevent the rotation of the detecting member 32 around the support shaft 33. In addition, as shown in FIGS. 8 to 10, in a state that the touching part 32*b* contacts the opposed face 2A' to prevent the rotation, in other words, in a state that the open/close member 2B is closed onto the frame 2A, the detecting part 32*a* of the detecting member 32 is located between the light-receiving and light-emitting parts of the sensor 31. To describe it more in detail, the touching part 32*b* extends obliquely upward with respect to the interior surface 2F' from substantially a center of the front-back direction of the above-mentioned main body 32A toward the side direction (outside direction), then extends substantially parallel to the interior surface 2F'. Therefore, the opposed face 2A' of the frame 2A, which the touching part 32*b* contacts, is arranged in the same height or higher place than the detecting member 32 (as viewed from the interior surface 2F'). Since the frame 2F and the frame 2A at least partially overlap in this manner such that the open/close member 2B is closed (or mounted) onto the frame 2A, it is possible to prevent foreign matter from entering on the side face of the traveling route formed by the frame 2A and the open/close member 2B.

In the above-described configuration, if the open/close member 2B is not reliably closed with respect to the frame 2A of the apparatus main body 2, the touching part 32*b* of the detecting member 32 becomes apart from the opposed face 2A', and the detecting member 32 is rotated around the support shaft 33 by the tension spring 34. At this time, the detecting part 32*a* of the detecting member 32 moves downward from the light-receiving and light-emitting parts of the sensor 31, and the movement is detected by the sensor 31. That is, if the open/close member 2B is not reliably closed onto the frame 2A of the apparatus main body 2, the state is detected by the sensor 31. That is, if the touching part 32*b* does not touch (or contact) the opposed face 2A', the detecting part 32*a* of the detecting member 32 is biased downward by the biasing force of the tension spring 34 and it is not a state that the open/close member 2B is reliably closed with respect to the frame 2A. In this case, the touching part 32*b* contact a bottom face 35 of a recess provided on the frame 2F of the open/close member 2B such that the rotation by the tension spring 34 is stopped. Therefore, as an opened state, the detecting part 32*a* of the detecting member 32 is moved to the position of the sensor 31 and such a movement is detected by the sensor 31. And in a state that the open/close member 2B is reliably closed with respect to the frame 2A of the apparatus main body 2, the touching part 32*b* of the detecting member 32 is in touch (or contact) with the opposed face 2A' such that the detecting part 32*a* of the detecting member 32 is between the light-receiving and light-emitting parts, thereby enabling the sensor 31 to detect it.

In this way, with respect to the open/close member 2B and the frame 2A forming the bill traveling route 3, since a mounting state (closed state) of the open/close member 2B with respect to the frame 2A can be reliably judged, it is possible to effectively prevent the bill from being jammed inside the bill traveling route 3 which is easily caused due to the open/close member 2B being not reliably closed with respect to the frame 2A. In particular, the touching part 32*b* and the opposed face 2A' are apart from the bill traveling route 3 such that it is less likely that the foreign matter (bill or the like) is jammed between the touching part 32*b* and the opposed face 2A', and it is considered that a main cause of the touching part 32 being apart from the opposed face 2A' is that the open/close member 2B is not reliably closed with respect to the frame 2A because of the foreign matter (bill or the like) in the bill traveling route 3 or the like.

Further, as shown in FIG. 4, since the open/close member 2B described above is supported by the axis 2S on one side so as to be able to open and close with respect to the frame 2A of the apparatus main body 2, and the sensor 31 is installed at the other side of the open/close member 2B, a stroke distance of rotation movement at the time of opening is longer on the side of the open/close member 2B where the sensor 31 is installed, thereby enabling the sensor 31 to reliably detect with ease that the open/close member 2B is opened.

With respect to the detecting member 32 configured as described above, as shown in FIG. 11A, it is preferable that an inclined surface 32*d* inclined to the surface (the interior surface 2F' of the frame 2F) of the open/close member 2B is formed on the detecting part 32*a* serving as the end thereof. When the open/close member 2B is opened from the frame 2A, the detecting member 32 is rotated around the support shaft 33 by the tension spring 34 such that the inclined surface 32*d* is moved closer to the interior surface 2F' of the frame 2F. By forming the inclined surface 32*d* on the end portion (the end portion on which the detecting part 32*a* is provided) of the detecting member 32 in this way, even if the detecting member 32 is moved close to the surface (the interior surface 2F') of the open/close member 2B as described above when the open/close member 2B is opened from the frame 2A, it is still possible to set large a rotation range of the detecting member 32 with respect to the interior surface because a portion which might have interfered with or contacted the interior surface is actually cut out, thereby enabling the sensor 31 to detect reliably the movement of the open/close member 2B. That is, as shown in FIG. 11B, if the touching part 32*b* is apart from the opposed face 2A' of the frame 2A, the touching part 32*b* contacts the bottom face 35 of the recess such that the rotation of the detecting member 32 is stopped as mentioned above. Since a hypothetical angle of the detecting part 32*a* matches the inclined surface 32*d*, it is possible to move downward a lot without contacting the interior surface 2F'. Here, if the opposed face 2A' and a contact face of the open/close member 2B are to contact with each other such that the frame 2A moves up (or the open/close member 2B moves down) as shown in an arrow in FIG. 11B so as to close the open/close member 2B, the touching part 32*b* contacts the opposed face 2A' of the frame 2A so as to move apart from the bottom face 35. And when the open/close member 2B is closed as shown in FIG. 11C, the touching part 32*b* is lifted as the opposed face 2A' contact it such that the detecting member 32 turns. Here, a window 36 is open such that the inside may be seen from the side and it is possible to check that the touching member 32*b* is lifted without any troubles. In this way, the touching part 32*b* contacts the opposed face 2A of the main apparatus 2 which is stopped by contacting the touching face 2G disposed on a higher position than the bottom portion and the bottom portion 35 of the open/close member 2B such that it is possible to judge whether it is closed or opened. Also, this contacting face is apart from the bill traveling route 3 and protected as it is surrounded by the recess of the open/close member 2B such that the apparatus is excellent in the durability.

Figure 12:
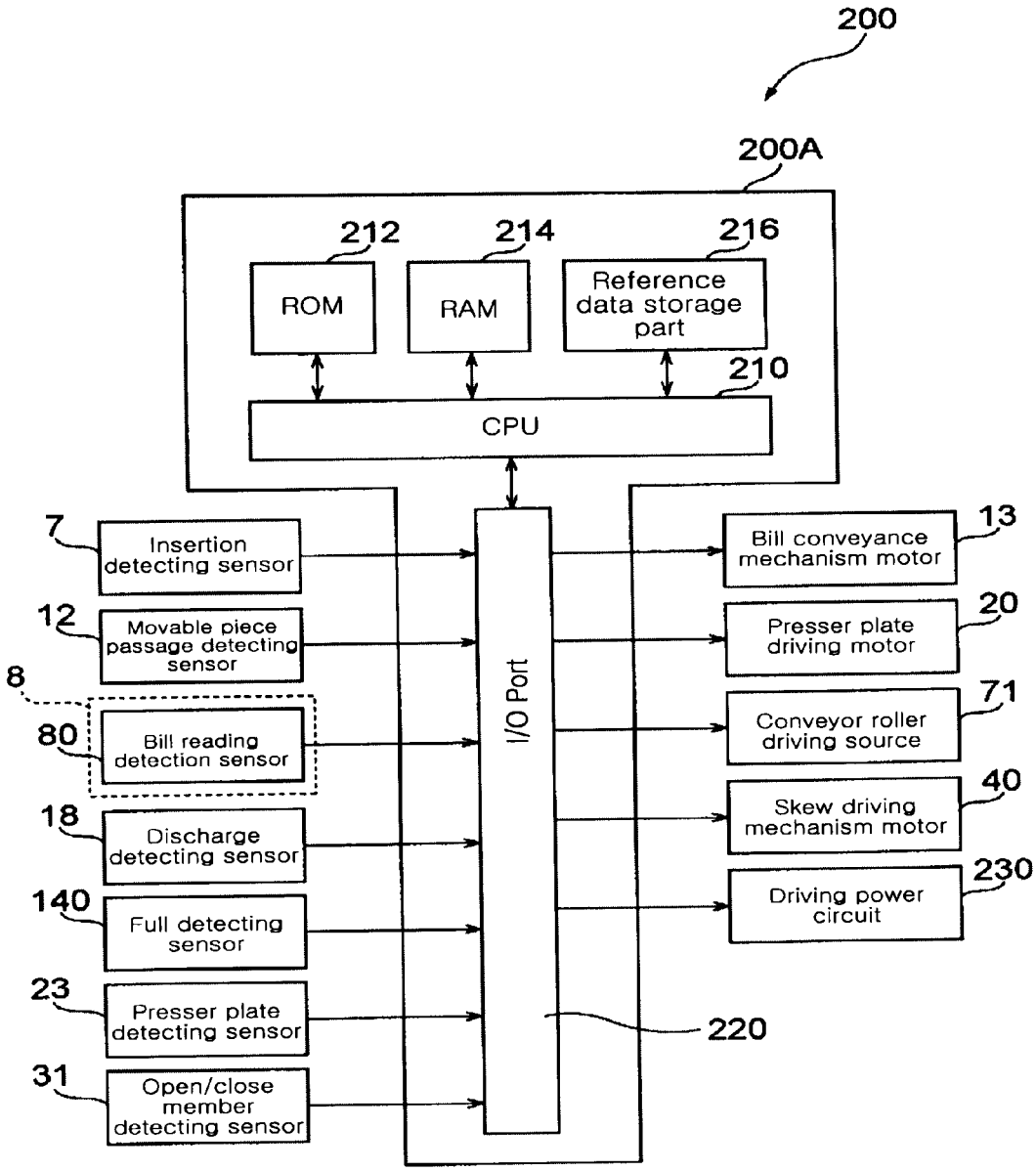
FIG. 12 is a block diagram showing control means to control operations of the paper sheet apparatus.

Next, the control means for controlling operations of the above-mentioned paper sheet processing apparatus will be explained with reference to FIG. 12.

The control means 200 comprises a control circuit board 200A that controls the operations of the respective drive units described above, and a CPU (Central Processing Unit) 210 constituting bill identification means, a ROM (Read Only Memory) 212, a RAM (Random Access Memory) 214, and a reference data storage part 216 are mounted on the control circuit board.

In the ROM 212, various types of programs such as operation programs for the respective drive units such as the motor 13 that drives the above-described bill conveyance mechanism, the motor 20 that drives the presser plate, the motor 71 that drives the conveyor roller 14A to contact/be spaced from the conveyor roller 14B, the motor 40 to drive the skew driving mechanism 10; an authenticity judgment program for the bill read by the bill reading means 8; and permanent data are stored. The CPU 210 generates control signals according to the programs stored in the ROM 212, carries out the input and output of the signals with respect to the respective drive units via an I/O port 220, and controls the driving of the respective drive units.

Further, detection signals from the insertion detecting sensor 7, the movable piece passage detecting sensor 12, the discharge detecting sensor 18, the full detecting sensor 140, and a presser plate detecting sensor 23, and an open/close member detecting sensor 31 are input to the above-mentioned CPU 210 and the driving of the respective drive units is controlled based on these detection signals.

Further, data and programs used for the operation of the CPU 210 are stored in the RAM 214, and reference data used for the performance of a bill authenticity judgment, for example, various types of data acquired from all the printing areas of the legitimate bill (such as data about contrasting density and data about transmitted light or reflected light when the bill is irradiated with infrared ray) are stored as reference data in the reference data storage part 216. In addition, the reference data is stored in the dedicated reference data storage part 216. However, the data may be stored in the ROM 212.

Then, a bill reading detection sensor (for example, a line sensor) 80 constituting the above-described bill reading means 8 is connected to the CPU 210 via the I/O port 220, and bill reading data read by the bill reading detection sensor 80 is compared with the reference data stored in the reference data storage part 216 such that a bill authenticity judgment process is executed.

Also, the above-mentioned CPU 210 is to transmit control signals to a driving power circuit 230 for driving for driving the apparatus main body 2 via the I/O port 220. When it is detected that the open/close member 2B is opened from the frame 2A by the above-mentioned open/close member detecting sensor 31, the CPU 210 transmits a control signal to cancel the power supply for the apparatus main body 2 to the driving power circuit 230.

According to such a configuration, when the open/close member 2B is opened from the frame 2A for maintenance or the like, the electric power supply to the apparatus main body 2 is stopped. Therefore, it is possible to prevent maintenance tools and various types of electric components from touching each other to short-circuit.

In addition, the control means 200 that controls the operation of the bill processing apparatus is implemented on one control circuit board 200A as mentioned above. However, the control means 200 may be implemented in a distributed manner on separate control circuit boards in accordance with respective functions.

As mentioned above, the embodiment of the present invention is described. However, the present invention is not limited to the above-described embodiment, and various modifications of the present invention can be implemented. It suffices for the present invention to be configured to be capable of detecting that the open/close member 2B forming the traveling route through which the paper sheet is conveyed is opened when being closed with respect to the apparatus main body, the open/close member 2B being provided and capable of being opened and closed with respect to the apparatus main body 2, such that a configuration of sensors and a configuration and an operation method of detecting members detected by the sensors may be modified accordingly.

In such a paper sheet processing apparatus having the configuration of the embodiments as described above, it is reliably possible to judge the mounting conditions of the frame forming the traveling route with respect to the open/close member such that it is possible to prevent effectively jamming of the paper sheet, which might be caused by the open/close member not being reliably closed with respect to the frame.

Also, in another aspect of the embodiment, the above-mentioned open/close member is supported by the shaft disposed on one side in an openable-and-closable manner with respect to the frame and the sensors may be set on the other side of the open/close member.

In such a configuration, since the sensor is installed on the other side which is a position apart from the one side supported rotatably by the axis, a stroke distance of rotation at the time of opening may be increased, thereby enabling the sensor to reliably detect that the open/close member is opened.

Yet another aspect of the above-described embodiment, the detection can be made by the above-mentioned sensor; the detecting member to rotate in accordance with the opening-and-closing operation of the open/close member is provided; an inclined surface to be inclined to the surface of the open/close member is formed on an end portion of the above-mentioned detecting member such that the inclined surface of the detecting member may be moved close to the surface of the open/close member when the open/close member is opened from the frame.

In such a configuration, the inclined surface is formed at the end of the detecting member rotating on the basis of an opening-and-closing operation of the open/close member, and when the open/close member is opened from the frame, the inclined surface of the detecting member moves in a direction of getting close to the surface of the open/close member. Therefore, it is possible to set a rotation range with respect to the surface of the detecting member large, which makes it possible to reliably carry out the detection of the open/close member by the sensor.

Also, in another aspect of the above-mentioned embodiment, control means to cancel the power supply when it is detected that the open/close member is opened from the frame by the above-mentioned sensor may be provided.

In such a configuration, when the open/close member is opened from the frame for maintenance or the like, the electric power supply to the apparatus is stopped. This may reduce the possibility that maintenance tools and various types of electric components touch each other to short-circuit.

According to the other aspect of the embodiment as mentioned above, a paper sheet processing apparatus which can effectively prevent jamming of the paper sheet in the traveling route may be provided.

The present invention can be incorporated into various types of apparatuses providing products and services by inserting a bill thereinto for example. It is also possible to apply it to a processing device to process a paper sheet such as a coupon ticket, not limited to, but including the bill.

What is claimed is:

1. A paper sheet processing apparatus comprising:

an open/close member to be opened and closed with respect to a frame; and a traveling route through which a paper sheet is conveyed, the traveling route being formed between the open/close member and the frame when the open/close member is closed with respect to the frame, wherein the open/close member comprises:

a sensor to detect that the open/close member is opened from the frame, a detecting member which is detectable by the sensor and capable of rotating based on an opening-and-closing operation of the open/close member, and an inclined surface formed on one end side of the detecting member, the inclined surface being inclined to a surface of the open/close member, wherein the inclined surface of the detecting member is moved in a closer direction to the surface of the open/close member when the open/close member is opened from the frame.

2. The paper sheet processing apparatus according to claim 1 wherein:

the open/close member is supported by an axis on one side with respect to the frame in an openable and closable manner; and the sensor is provided on another side of the open/close member.

3. The paper sheet processing apparatus according to claim 1, further comprising:

a controller configured to cancel a power supply for the paper sheet processing apparatus when the sensor detects that the open/close member is opened from the frame.

4. The paper sheet processing apparatus according to claim 2, further comprising:

a detecting member being detectable by the sensor and capable of rotating based on an opening-and-closing operation of the open/close member; and an inclined surface formed on one end side of the detecting member, the inclined surface being inclined to a surface of the open/close member, wherein the inclined surface of the detecting member is moved in a closer direction to the surface of the open/close member when the open/close member is opened from the frame.

5. The paper sheet processing apparatus according to claim 2, further comprising:

a controller configured to cancel a power supply for the paper sheet processing apparatus when the sensor detects that the open/close member is opened from the frame.

6. The paper sheet processing apparatus according to claim 2, further comprising:

a controller configured to cancel power supply for the paper sheet processing apparatus when the sensor detects that the open/close member is opened from the frame.

7. A paper sheet processing apparatus comprising:

a frame constituting an apparatus main body;

an open/close member being capable of opening and closing by rotation with respect to the frame and forming a traveling route between the frame and the open/close member when the open/close member is closed through which a paper sheet is conveyed; and a sensor being capable of detecting an open/close state and provided apart from the traveling route, wherein the sensor detects a detecting part of a detecting member moving in synchronization with an opening-and-closing operation of the open/close member;

the detecting member comprises a touching part to make a contact when the open/close member is closed and an inclined surface on an end portion of the detecting part, the inclined surface moved largely in a closer direction to a surface of the open/close member when the open/close member is opened from the frame; and a movement of the detecting part is restricted via the touching part and the detecting member by the contact.

8. The paper sheet processing apparatus according to claim 7, wherein:

the open/close member is rotatably supported by an axis on one side with respect to the frame;

the sensor is provided on another side of the open/close member.

9. The paper sheet processing apparatus according to claim 8, wherein:

the sensor detects a detecting part of a detecting member moving in synchronization with an opening-and-closing operation of the open/close member;

the detecting member comprises a touching part to make a contact when the open/close member is closed; and a movement of the detecting part is restricted via the touching part and the detecting member by the contact.

10. The paper sheet processing apparatus according to claim 8, comprising:

a controller configured to control by regulating a power supply for the paper sheet processing apparatus when the sensor detects that the open/close member is opened from the frame.

11. The paper sheet processing apparatus according to claim 7, comprising:

a controller configured to control by regulating a power supply for the paper sheet processing apparatus when the sensor detects that the open/close member is opened from the frame.

12. The paper sheet processing apparatus according to claim 7, comprising:

a control device to control by regulating power supply when the sensor detects that the open/close member is opened from the frame.

* * * * *